US005759341A

United States Patent [19]

Kobayashi

[11] Patent Number: 5,759,341

[45] Date of Patent: Jun. 2, 1998

[54] MECHANISM FOR THE SUPPLY AND TAKEUP OF A TRANSFER TAPE IN AN APPLICATOR

[75] Inventor: Kenji Kobayashi, Tokyo, Japan

[73] Assignee: Tombow Pencil Co., Ltd., Tokyo, Japan

[21] Appl. No.: 736,447

[22] Filed: Oct. 24, 1996

[30] Foreign Application Priority Data

Oct. 27, 1995 [JP] Japan ..... 7-302294

[51] Int. Cl.[6] ..... B32B 31/00

[52] U.S. Cl. ..... 156/540; 156/577; 156/579; 242/171; 242/588.2; 242/588.6; 225/41; 225/46

[58] Field of Search ..... 156/523, 527, 156/574, 577, 579, 540; 242/160.4, 171, 588, 588.2, 588.3, 588.6; 225/41, 46

[56] References Cited

U.S. PATENT DOCUMENTS

| | | | |
|---|---|---|---|
| 3,740,299 | 6/1973 | Schroter et al. | 156/577 |
| 3,969,181 | 7/1976 | Seabold | 156/577 |
| 4,668,326 | 5/1987 | Mistyurik | 156/577 X |
| 4,718,971 | 1/1988 | Summers | 156/577 X |
| 5,110,401 | 5/1992 | Huang | 156/579 X |
| 5,310,445 | 5/1994 | Tucker | 156/577 X |
| 5,346,580 | 9/1994 | Elges et al. | 156/579 X |
| 5,430,904 | 7/1995 | Ono et al. | 156/577 X |
| 5,507,908 | 4/1996 | Fukushima et al. | 156/577 X |
| 5,556,469 | 9/1996 | Koyama et al. | 156/577 X |

*Primary Examiner*—Mark A. Osele

*Attorney, Agent, or Firm*—Baker, Donelson, Bearman & Caldwell

[57] ABSTRACT

A supply reel collar from which a transfer tape for an adhesive, or correction coating can be unwound in an applicator is fitted on a supply gear and about its hollow cylindrical shaft portion having an upwardly facing shoulder on its outer surface and a downwardly facing shoulder on its inner surface. A retainer has an upper portion engaging the collar and a lower portion engaging the downwardly facing shoulder. A coiled spring is held in a compressed shape between the upwardly facing shoulder and the upper portion of the retainer to ensure tight engagement between the shaft portion and the retainer and thereby between the supply gear and the collar.

2 Claims, 3 Drawing Sheets

MECHANISM FOR THE SUPPLY AND TAKEUP OF A TRANSFER TAPE IN AN APPLICATOR

BACKGROUND OF THE INVENTION

1. Field of the Invention

This invention relates to an applicator for an adhesive, or correction coating, and more particularly, to a mechanism for the supply and takeup of a transfer tape for the adhesive, or correction coating.

2. Description of the Prior Art

There is known an applicator which is used to apply an adhesive, or correction coating by means of a transfer tape. The applicator contains a mechanism for the supply and takeup of the transfer tape. The mechanism includes a supply reel collar and a supply gear forming an integral part thereof, as well as a takeup reel collar and a takeup gear forming an integral part thereof and meshing with the supply gear. The gears are rotatable to unwind an unused transfer tape from the supply reel collar and supply it to a transfer head at one end of the applicator, while receiving the used portion of the tape from the transfer head and rewinding it on the takeup reel collar. If the rewound tape is removed, a new transfer tape can be set in the applicator.

Each of the gears is rotatably supported by a shaft projecting from the inner wall of the applicator and fitter tightly in the corresponding reel collar. An O-ring is fitted between the shaft for the supply gear and the supply reel collar for holding the supply gear against rotation independently of the supply reel collar. The O-ring is, however, expensive and yet is unable to hold the supply reel collar and the shaft for the supply gear tightly together unless the collar, or shaft has an accurate inside, or outside diameter. The manufacture of these parts with the accurate dimensions undesirably adds to the cost of inspection. Moreover, the conditions of the surfaces between which the O-ring is fitted are very likely to vary with temperature and humidity.

Therefore, there is also known a structure which does not rely upon any O-ring for holding a supply reel collar against rotation independently of a supply gear. The collar is L-shaped in cross section and has an inwardly projecting portion fitted on the shaft for the supply gear. A coiled spring is fitted in a clearance between the collar and the gear shaft coaxially with the latter, and is forced down by a member placed on its top to hold the bottom of the collar in tight engagement with the upper surface of the gear. The supply reel collar having an L-shaped cross section as described above has, however, a correspondingly enlarged outside diameter and calls for an enlarged applicator casing to maintain the amount of a transfer tape wound on the collar. Moreover, the removal of the upper portion of the casing from its lower portion for e.g. the replacement of the tape by a new one is likely to cause the spring to jump out of the casing, and the resetting of the spring is a job which would otherwise be unnecessary.

SUMMARY OF THE INVENTION

Under these circumstances, it is an object of this invention to provide an improved structure which makes it possible to hold a supply reel collar against rotation independently of a supply gear without employing any O-ring, or any diametrically enlarged supply reel collar.

The improved structure of this invention comprises a supply reel collar having a plurality of recesses at its top and, a supply gear having a hollow cylindrical shaft portion situated in the collar and having an upwardly facing shoulder on its outer surface and a downwardly facing shoulder on its inner surface, the improved structure further comprises a retainer having an upper portion provided with a plurality of radially outwardly directed protrusions each fitted in one of the recesses of the collar, and a hollow cylindrical and radially inwardly flexible lower portion provided at its lower end with a plurality of radially outwardly directed protrusions engaging the downwardly facing shoulder of the supply gear shaft portion the improved structure further comprises a coiled spring fitted in a clearance formed between the collar and the supply gear shaft portion and between the collar and the retainer coaxially with the supply gear shaft portion, the spring has an upper end engaging the retainer to urge it upwardly and a lower end engaging the upwardly facing shoulder of the supply gear shaft portion to urge it downwardly.

The spring ensures the tight engagement between the protrusions of the lower portion of the retainer, which are upwardly urged, and the downwardly facing shoulder of the supply gear shaft portion, which is downwardly urged, so that the supply reel collar may be held against rotation independently of the supply gear, even if the applicator may be used powerfully. It is economically advantageous that the supply reel collar itself does not substantially differ from its counterpart in a conventional applicator including an O-ring, but no longer requires any O-ring, nor does it need to be diametrically enlarged to maintain the amount of a transfer tape which can be wound on it.

Other features and advantages of this invention will become apparent from the following description and the accompanying drawings.

DETAILED DESCRIPTION OF THE INVENTION

Figure 1:
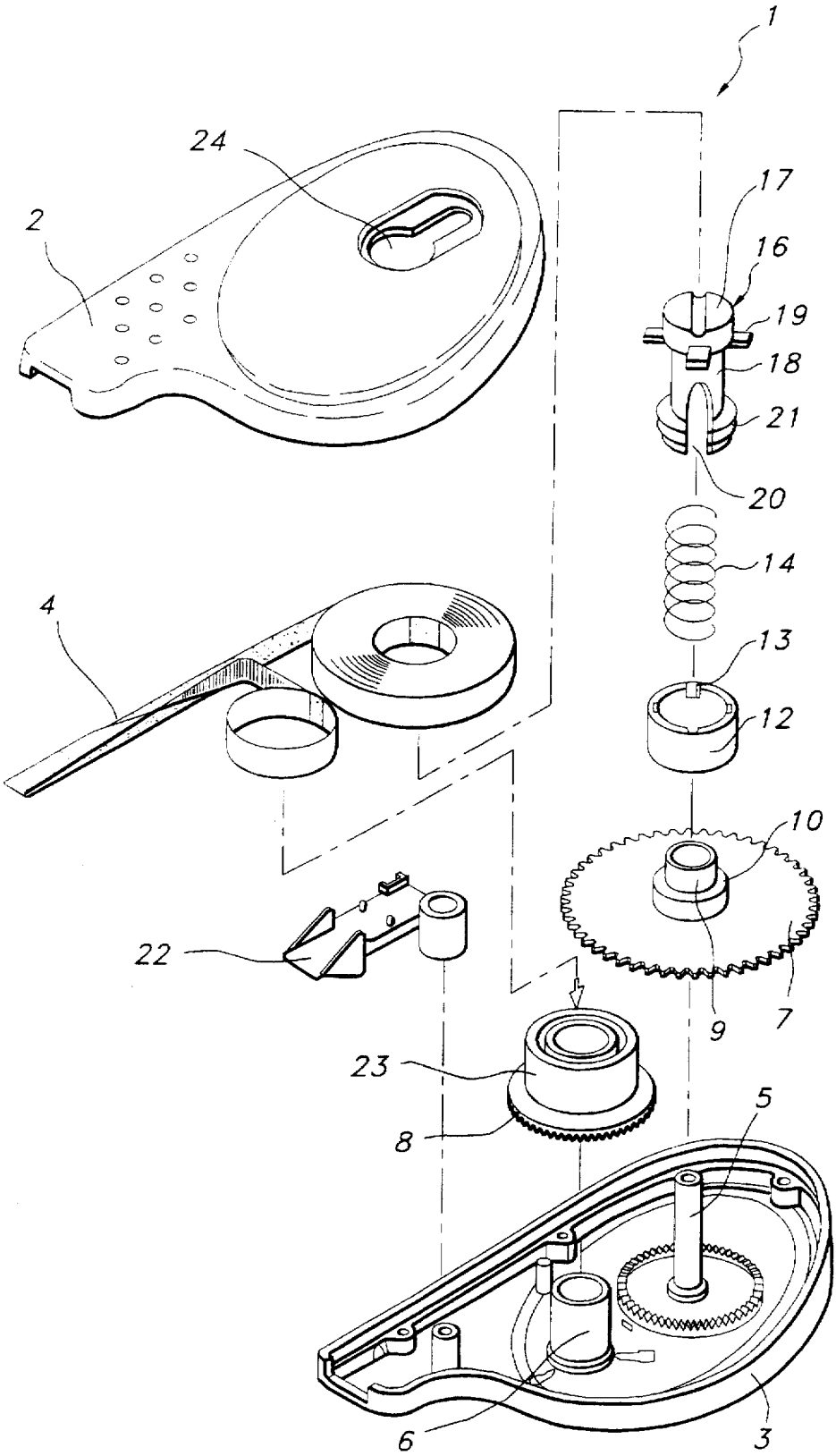
FIG. 1 is an exploded perspective view of an applicator embodying this invention.
Figure 2:
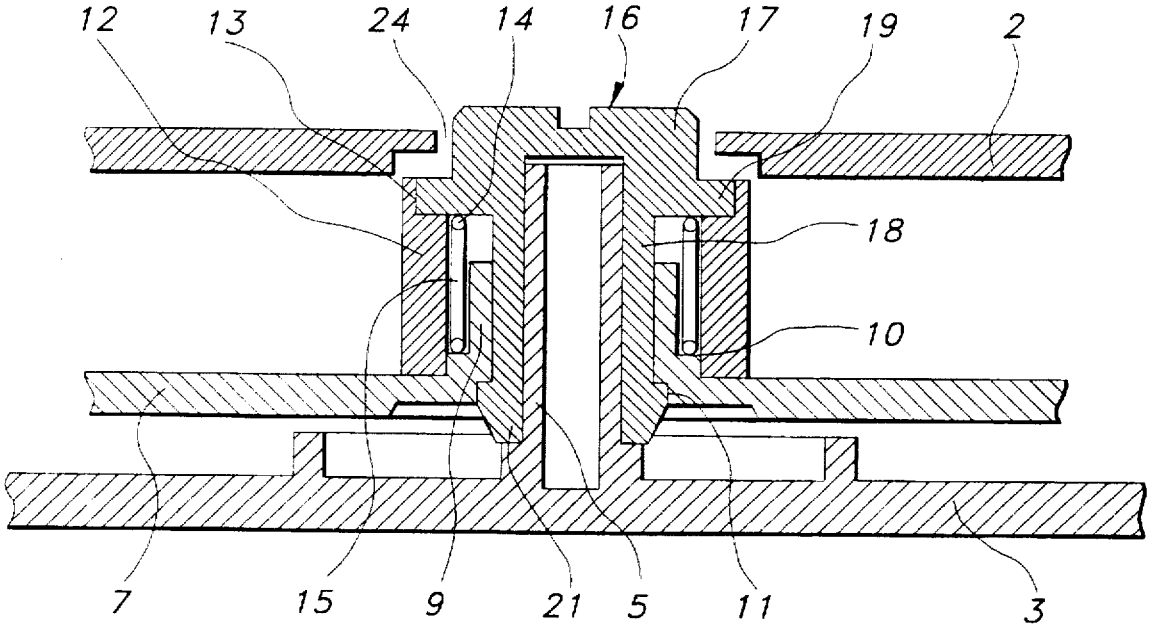
FIG. 2 is an enlarged longitudinal sectional view of a part of the applicator.

An applicator embodying this invention is generally shown at 1 in FIG. 1, and comprises a casing which is separable into an upper portion 2 and a lower portion 3, and which contains a mechanism for the supply and takeup of a transfer tape 4. A supply gear rotating shaft 5 and a takeup gear rotating shaft 6 form integral parts of the lower casing portion 3, and are so positioned that a supply gear 7 and a takeup gear 8 fitted about the shafts 5 and 6, respectively, may mesh with each other. The supply gear 7 has a hollow cylindrical shaft portion 9 having an upwardly facing annular shoulder 10 on its outer surface and a downwardly facing annular shoulder 11 on its inner surface, as shown in FIG. 2. A supply reel collar 12 is fitted about the shaft portion 9 of the supply gear 7 and engages the supply gear 7 and its shaft portion 9 around its shoulder 10. The collar 12 has four equally spaced apart recesses 13 at the top of its cylindrical wall. A coiled spring 14 is fitted about the supply gear shaft portion 9 coaxially therewith. The supply gear shaft portion 9 and the collar 12 define therebetween an annular clearance 15 in which the spring 14 is fitted. A retainer 16 has a head, or upper portion 17 engaging the upper end of the collar 12 and a hollow cylindrical and radially flexible lower portion 18 fitted between the supply gear rotating shaft 5 and the supply gear shaft portion 9. The upper portion 17 has four radially outwardly directed protrusions 19 each fitted in one of the recesses 13 of the collar 12. The lower portion 18 is open at its lower end, and has two diametrically opposite and vertically or axially extending slits 20 which are open at the lower end of the lower portion 18. The lower portion 18 also has two radially outwardly directed protrusions 21 engaging the downwardly facing shoulder 11 of the supply gear shaft portion 9. The clearance 15 has an upper end defined by the upper portion 17 of the retainer 16, and a lower end defined by the upwardly facing shoulder 10 of the supply gear shaft portion 9. The supply gear shaft portion 9 has an upper end spaced below the upper portion 17 of the retainer 16. The spring 14 has an upper end engaging the upper portion 17 of the retainer 16 and a lower end engaging the shoulder 10 of the supply gear shaft portion 9, and is compressed therebetween.

Figure 3:
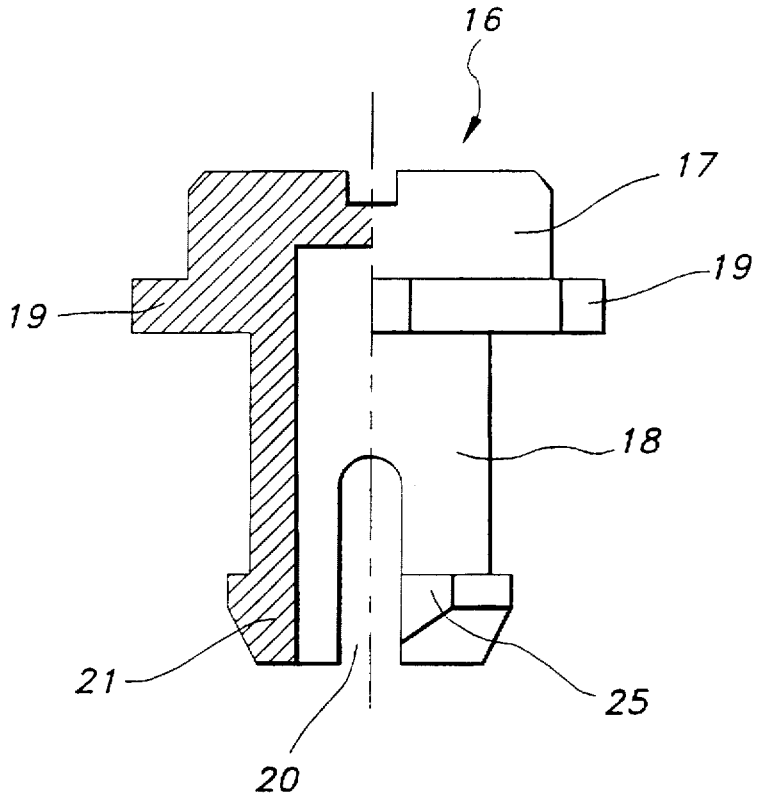
FIG. 3 is an enlarged side elevational view, partly in section, of a retainer.
Figure 4:
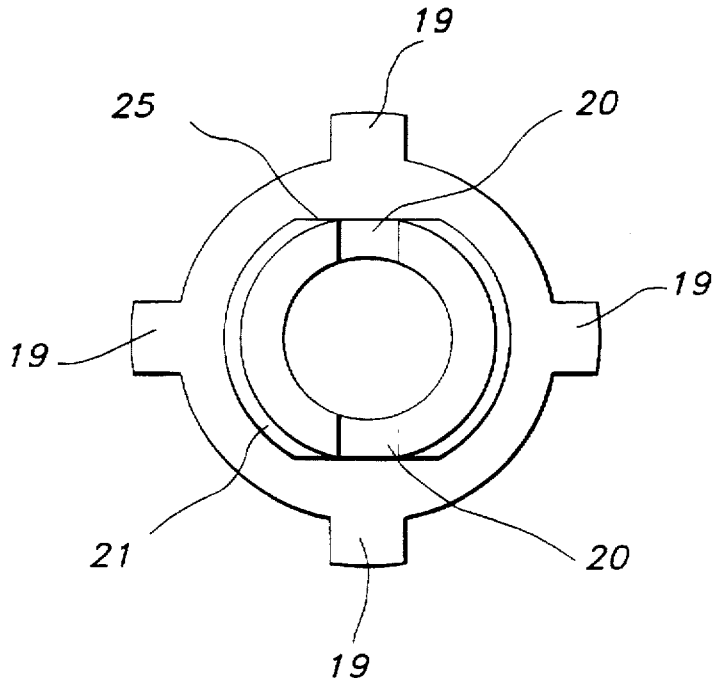
FIG. 4 is a bottom plan view of the retainer.

The lower casing portion 3 has a transfer head 22 at one end. The transfer tape 4 is unwound from the supply reel collar 12, passed around the transfer head 22, and rewound on a takeup reel collar 23 attached to the takeup gear 8 coaxially therewith. The upper casing portion 2 has a retainer window 24 through which access can be made to the retainer 16, so that, should the transfer tape 4 become slack, the retainer 16 and thereby the supply reel collar 12 may be turned to tauten the tape 4. The retainer 16 has a pair of diametrically opposite straight portions 25 extending across the slits 20 and between the protrusions 21, as shown in FIGS. 3 and 4. The inner surface of the supply gear shaft portion 9 has below the downwardly facing shoulder 11 a pair of flat portions engaging the straight portions 25, respectively, of the retainer 16 to prevent the retainer 16 from rotating relative to the supply gear shaft portion 9.

The slits 20 make the lower portion 18 of the retainer 16 radially flexible, so that it may be radially inwardly deformed to facilitate its insertion in the supply gear shaft portion 9 when the applicator is assembled.

The spring 14 held in its compressed shape between the upwardly facing shoulder 10 of the supply gear shaft portion 9 and the upper portion 17 of the retainer 16, as already described, urges the supply gear shaft portion 9 downwardly and the retainer 16 upwardly, and thereby gives a downward force to the downwardly facing shoulder 11 of the supply gear shaft portion 9 and an upward force to the protrusions 21 engaging the shoulder 11. These oppositely directed forces ensure the tight engagement between the shoulder 11 and the protrusions 21 thereon, the retainer 16 makes it possible to prevent the supply reel collar 12 from rotating relative to the supply gear 7. The downwardly facing shoulder 11 on the inner surface of the supply gear shaft portion 9 does not necessarily need to be circular and continue along the entire circumference of the shaft portion 9, but may alternatively consist of a plurality of segments each engaging one of the protrusions 21.

What is claimed is:

1. In a mechanism for the supply and takeup of a transfer tape for an adhesive, or correction coating in an applicator including a supply gear and a takeup gear which are rotatable together to unwind an unused portion of the tape from a supply reel collar and the tape to a transfer head at one end of an applicator casing, while receiving the used portion of the tape from the transfer head and rewinding the tape on a takeup reel collar, the improvement which comprises:

said supply reel collar having a plurality of recesses disposed about a top of said collar;

said supply gear having a hollow cylindrical shaft portion disposed within said supply reel collar and having an upwardly facing shoulder on an outer surface thereof and a downwardly facing shoulder on an inner surface thereof;

a retainer having an upper portion provided with a plurality of radially outwardly directed protrusions each fitted in one of said recesses, and a hollow cylindrical and radially flexible lower portion provided at its lower end with a plurality of radially outwardly directed protrusions engaging said downwardly facing shoulder; and a coiled spring disposed in an annular clearance formed between said supply reel collar and said shaft portion and between said supply reel collar and said retainer, said spring being disposed coaxially with said shaft portion and having an upper end engaging said retainer to urge said retainer upwardly and a lower end engaging said upwardly facing shoulder to urge said upwardly facing shoulder downwardly.

2. A mechanism as set forth in claim 1, wherein said lower portion of said retainer has a plurality of slits which are parallel to said shaft portion, and open at said lower end of said lower portion of said retainer.

* * * * *

UNITED STATES PATENT AND TRADEMARK OFFICE

CERTIFICATE OF CORRECTION

PATENT NO. : 5,759,341
DATED : June 2, 1998
INVENTOR(S) : Kenji Kobayashi

It is certified that error appears in the above-identified patent and that said Letters Patent is hereby corrected as shown below:

Column 4,
Line 2, after "21," "thereon" is deleted and in place thereof -- . Therefore, -- is inserted.

Signed and Sealed this

Fourth Day of June, 2002

*Attest:*

*Attesting Officer*

JAMES E. ROGAN
*Director of the United States Patent and Trademark Office*